United States Patent [19]

Paersch et al.

[11] Patent Number: 4,501,593

[45] Date of Patent: Feb. 26, 1985

[54] PROCESS FOR THE PRODUCTION OF AGGLOMERATED FUELS

[75] Inventors: Michael Paersch, Aachen; Herbert Mrotzek; Helmut Haukelt, both of Hamburg; Heinz-Wilhelm Schreckenberg, Brilon, all of Fed. Rep. of Germany

[73] Assignee: The British Petroleum Company p.l.c., London, England

[21] Appl. No.: 502,747

[22] Filed: Jun. 9, 1983

[30] Foreign Application Priority Data

Jun. 22, 1982 [DE] Fed. Rep. of Germany ..... 3223194

[51] Int. Cl.[3] ..... C10L 5/16; C10L 5/22

[52] U.S. Cl. ..... 44/23; 44/15 B; 44/15 C; 75/3

[58] Field of Search ..... 44/15 B, 15 C, 16 C, 44/19, 23, 6; 75/3

[56] References Cited

U.S. PATENT DOCUMENTS

| | | | |
|---|---|---|---|
| 374,560 | 12/1887 | Saltery | 75/3 |
| 2,808,325 | 10/1957 | Subervie | 75/3 X |
| 3,323,901 | 6/1967 | Dahl et al. | 75/3 |
| 3,655,350 | 4/1972 | Utley | 44/19 X |
| 4,302,209 | 11/1981 | Baker et al. | 44/23 X |

OTHER PUBLICATIONS

*3rd International Symposium for Agglomeration,* Nuremberg, 1981, pp. H36–51.

*Primary Examiner*—Carl F. Dees

*Attorney, Agent, or Firm*—Morgan, Finnegan, Pine, Foley & Lee

[57] ABSTRACT

In the pelletization of particles of carbonaceous material improvements in pellet strength are obtained by applying a first water soluble or swellable thermo-hardening binder and a second binder which is an emulsion of a heavy hydrocarbon in such a way that the concentration of the first binder decreases from the interior to the exterior of the pellet, and the concentration of the second binder increases from the interior to the exterior of the pellet.

10 Claims, 2 Drawing Figures

PROCESS FOR THE PRODUCTION OF AGGLOMERATED FUELS

The invention relates to a process for the production of agglomerated fuels (pellets) from finely-divided carbonaceous material, a first, water-soluble or water swellable thermo-hardening binder and a second binder comprising an aqueous emulsion of heavy hydrocarbons.

The pelletising of finely divided solid carbonaceous fuel eg coal is described in a paper by K. V. S. Sastry and V. P. Mehrotra which was given at the 3rd International Symposium for Agglomeration at Nürnberg (1981), pages H 36–51. This paper explains that the fine coal particles (fines) can be agglomerated by various techniques including pelletisation. The paper further explains that pelletisation is a process in which fine particles wetted with liquid are tumbled in devices such as drums, discs or cones to form larger spherical bodies. The paper distinguishes between three different techniques of agglomeration namely (1) pelletisation, (2) pressure compaction, and (3) extrusion.

The present application is concerned with pelletisation. Sastry and Mehrotra describe the use of binders to improve the strength, abrasion resistance, and impact resistance of the pellets. The combination of corn starch and asphalt emulsion is mentioned. The asphalt emulsion makes the pellets waterproof.

Derwent Abstract 02755E/02 published by Derwent Publications Limited discloses a process for making metallurgical moulded coke by mixing bituminous material with coal and a water soluble thermosetting binder eg starch. This discloses a moulding or pressure compaction process not a pelleting process.

By pelletising finely-divided and very finely-divided coals which are difficult to handle, products which are low in dust and therefore kind to the environment and simple to transport, can be produced. The composition of such fuel pellets can be adapted very accurately to the requirements of the respective purpose of use (firing or gasification plant) and afford a simple, trouble-free plant operation. By setting the pellet size or by adding additives, for example desulphurisation agents, catalysts or the like, a defined combustion or gasification behaviour with a high degree of combustion or carbon conversion with far-reaching sulphur fixing can be achieved. The pelletising of powdered coal or coal fines is also of importance because a high grade fuel can be produced from it for traditional grate firing, which is equivalent in its properties to the expensive nut coal which would otherwise be necessary, and in some cases even excels it.

The production of coal pellets, however, is not without its problems. The choice of the initial substances and the production process are decisive for the properties of the agglomerates obtained. As regards transport, the mechanical strength of the pellets is of the highest importance. It must also be largely preserved when the fuel is exposed to damp weather for long periods. On the other hand, the fuel pellets must not have a tendency to stick together under a moderate heat action, for example sunshine.

The process according to the invention makes it possible to produce coal pellets which possess a high green strength and after drying and hardening a surprisingly high strength, especially crushing strength, which is preserved even in damp surroundings.

According to the present invention the process for the pelletisation of finely divided solid carbonaceous material using a first binder which is a variable-soluble or swellable thermo-hardening material and a second binder which is an aqueous emulsion of a heavy hydrocarbon and comprising the steps of drying and then thermally hardening the pellets is characterised by the fact that by adding the first and second binder separately during the pelletisation process, a concentration gradient of the binders is produced, the concentration of the first binder in the pellet decreasing from the interior to the exterior and that of the second binder from the exterior to the interior.

Examples of suitable feedstock for the process of the invention are coal fines, coal dust and filter coals, dust from graders, coal slurries and the like with a particle size of 0 to 3 mm and a water content of less than 20 percent by weight may be used. According to the preferred particle size distribution of the coal charge, 90% of the particles have a particle size of less than 1 mm; preferably the water content amounts to less than 12 percent by weight. Petroleum coke may also be used.

The above-mentioned carbonaceous charge is mixed with any solid additives which may be desired, for example a desulphurising agent, preferably limestone dust, burnt or slaked lime, chalk, dolomite and the like, and fed to the pelletising plant. The fraction of solid additives may amount to up to 15 percent by weight, provided the additives have a similar particle size distribution to that of the coal charge. By its nature, the charge coal generally used is hard coal.

The total solid particulate material to be pelletised including any solid particulate additives such as desulphurising agents will hereinafter be referred to as the pelletising mass.

The pelletisation process is a well-known process as can be seen from the Sastry and Mehrotra paper mentioned above. Thus the pelletisation process may be carried out using the known pelletising devices eg discs, drums, and cones. Pelletising discs have proved to be particularly suitable for the process of the invention.

In this specification the term "pelletising process" includes not merely the pelletising step in which finely divided particles are caused to agglomerate together in a pelletising device eg pelletising disc, cone, or drum but also any initial treatment of the finely divided carbonaceous material before it is fed to the pelletising device eg mixing with additives such as desulphurisation agents as well as any treatment with binders before the pelletisation step.

The first binder may be any of the known water-soluble or water-swellable thermo-hardening binders, for example starch, sulphite liquor, preferably molasses or mixtures of these. As heavy hydrocarbons for the aqueous emulsion are to be added as the second binder, in particular residues from petroleum processing and upgrading of coal, for example bitumen, heavy fuel oil, paraffins, pitches and the like, and mixtures of these. The water content of these emulsions amounts to between 30 to 70 percent by weight, preferably 40 to 60 percent by weight. The heavy hydrocarbon preferably has a viscosity greater than 50 cSt at 100° C. Preferably the viscosity at 20° C. is greater than 10 000 cSt.

Preferably the first binder is added to the pelletising mass in a total quantity of 1 to 5, especially 1.5 to 3 percent by weight, calculated as dry substance and reckoned on the quantity of the carbonaceous material used. The preferred quantity of hydrocarbons, reckoned on the carbonaceous material used, amounts to 1 to 6, especially 2 to 4 percent by weight.

The first and second binders are conveniently added by spraying.

The size of particles increases as the charge moves through the pelletising process from the initial individual particles of the pelletising mass to small agglomerates initially produced in the pelletising step and then to larger agglomerates finally recovered from the pelletising step. The required distribution of first and second binders may be obtained by adding the first binder preferentially to the initial individual particles and/or to the smaller agglomerates, and adding the second binder preferentially to the larger agglomerates. It may be advantageous to add at least part of the first binder to the pelletising mass before it is fed to the pelletising step.

The second binder, and usually the first binder, is fed to the pelletising step.

In the pelletising step the particles initially fed to the pelletising step form small agglomerates which become larger by the accretion of additional particles. The required concentration gradients may therefore be obtained by preferentially treating the particles fed to the pelletising step and/or the initial, smaller, agglomerates with the first water swellable or water-soluble binder and preferentially treating subsequently produced larger agglomerates with the second binder. In some pelletising devices e.g. continuous pelletising discs, cones, or drums, the different size agglomerates are found at fixed locations within the pelletising device and the required concentration gradient can be obtained by introducing the binders at different portions of the pelletising device. Thus the concentration gradient in the green pellets is adjusted by applying the first binder mainly to the non-agglomerated pelletising mass or the smaller agglomerates, and the second binder mainly to the large agglomerates. In this way in continuous operation the concentration gradient is produced preferably by a suitable arrangement of the distributing means in the pelletising devices. As is known, in such devices a classifying effect occurs (cf K. Meyer, Pelletising of iron ores, Springer-Verlag, Berlin 1980, page 204); the pellets of varying size are separated from each other to a greater or lesser degree, distinct flow lines forming in the material being processed. As a result of the utilisation by the invention of these flow lines for feeding in the binders, the desired concentration gradient can be obtained. Thus the heavy hydrocarbon emulsion may be fed to a portion of the pelletising device at which larger agglomerates are preferentially found, while the water-soluble or swellable binder may be fed to a portion of the pelletising device at which feed particles and/or smaller agglomerates are preferentially found. As already mentioned, the water swellable or soluble binder may also be fed to the feed particles before they are fed to the pelletising device e.g. pelletising disc or cone. This treatment of the feed particles before they are fed to the pelletising device may be carried out with or without addition of water-swellable or soluble binder to the pelletising device.

In some pelletising devices there may be no fixed spatial separation of the different size agglomerates but the size of the agglomerates present at a given part of the equipment will increase with time. The necessary concentration gradients can then be obtained by introducing the binders at different times.

According to a further advantageous embodiment of the invention, in a discontinuous production of pellets, that it to say when fresh coal material is not being continually introduced into the pelleting device and pellets of the desired size are not being withdrawn, the concentration gradient in the green pellets can be adjusted by application periods for the first and second binder of varying lengths, the pelletising mass or the pellets being treated alternately with the first and second binder, and the treatment times—for given binder concentrations—being set continually shorter for the first binder and continually longer for the second binder.

Naturally, one can also apply the first binder mainly to the non-agglomerated pelletising mass or the smaller agglomerates and the second binder mainly to the larger agglomerates even with discontinuous production, even when a stationary state of the flow lines does not form with the discontinuous operation of the pelletising device.

The size of the pellets produced according to the invention can be adjusted by the residence time in the pelletising device and by the water content in the pellet (e.g. 14–24, preferably 16–20 percent by weight for average pellet sizes of 6–22 mm, preferably 8–15 mm). The water content of the pellets is adjusted by diluting the water-soluble or water-swellable binder and by the water content in the emulsion. For the residence time of the pellets in the pelletising device, the inclination of the pelletising device, and its rotation speed in particular, are decisive.

The consolidation of the agglomerates (green pellets) leaving the pelletising device takes place as a result of a two-stage thermal post-treatment. According to one advantageous mode of embodiment of the invention, the green pellets are dried at a temperatures of 80° to 180°, especially 110° to 150° C., down to a water content 0.5–6, especially 1–3 percent by weight. According to a further embodiment of the process according to the invention, the dried green pellets are hardened at temperatures of 200° and 350°, especially 200° to 300° C. According to a further embodiment of the invention, the green pellets are maintained in motion while they are dried. Conventional apparatus may be used for this purpose, e.g. vibrating dryers.

The pellets produced according to the process of the invention are surprisingly strong, and they retain their strength even after moisture treatment. This strength may be determined, for example, as crushing strength (point pressure strength) (K Meyer, loc. cit., page 80) after storage of the pellets over 72 hours at 25° C. and an air humidity of 100%. The advantageous properties of the pellets produced according to the invention are only achieved in their entirety if all the features of the process of the invention are fulfilled. For example, if the second stage of the thermal post-treatment is suppressed, after storage in the damp, the pellets have completely unsatisfactory crushing strength. If pelletising is carried out without water-soluble or water-swellable thermo-hardenable binders, that is to say using exclusively hydrocarbon emulsions, products are obtained with a sticky surface, even if a thermal drying is first carried out at a low temperature followed by hardening at a higher temperature. If pellets are produced in which the opposed concentration gradient described is not present for the first and second binders, after treatment in the damp the crushing strength is distinctly lowered as compared with pellets produced according to the invention with the same overall composition.

BRIEF DESCRIPTION OF THE DRAWINGS

The process of the invention will be explained in greater detail on the basis of the following description, reference being had to the drawings.

Figure 1:
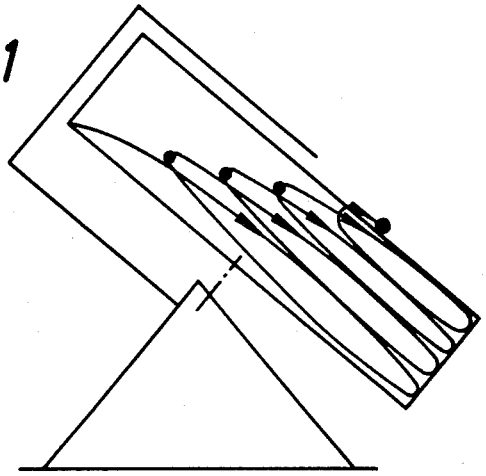
FIG. 1 shows a diagrammatical representation of a pelletising disc, in cross-section.
Figure 2:
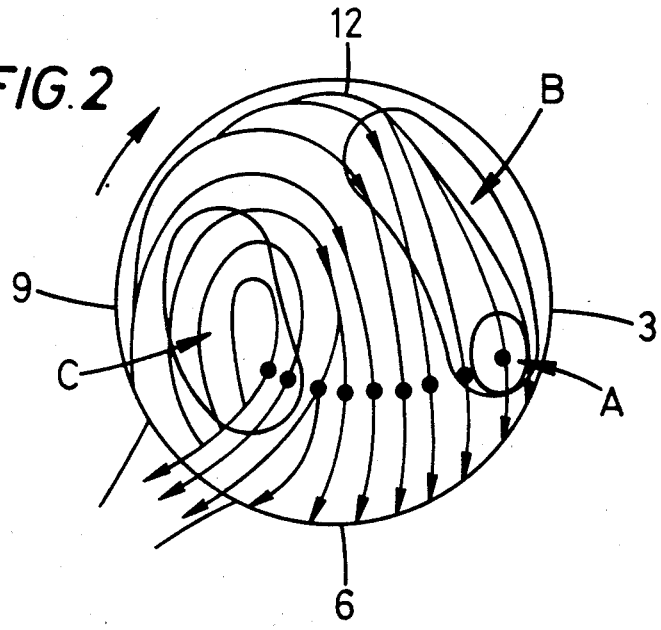
FIG. 2 shows a diagrammatical representation of a pelletising disc according to FIG. 1, in plan view.

According to FIGS. 1 and 2 the supply of the carbonaceous material takes place normally in a zone A of the rotation plane of the disc, in which the pellet cores are formed, that is to say when the disc rotates clockwise and with a top view between the 3 and 4 o'clock position (the 12 o'clock position corresponds to the top apex of the rotating disc; the 3, 6, 9 and 12 o'clock positions are marked in FIG. 2 with the reference numbers 3, 6, 9 and 12) at a distance of 0.6–0.9 R from the centre point of the disc (R = radius of disc). The feed of the water-soluble binder takes place, when the disc is rotating clockwise and seen from the top, in the right-hand half of the disc, preferably in zone B between the 12 and 14 o'clock position at a distance of 0.4–0.9 R from the disc centre. The feed of the hydrocarbon emulsion takes place, when the disc is rotating clockwise and seen from above, in the left-hand half of the disc, preferably in the zone between the 7 and 10 o'clock position at a distance of 0.1–0.7 R from the disc centre; this feed zone is marked C.

The optimum position of the spray zones B, C and the feed zone A depends on the operating parameters of the pelletising disc, for example on the angle of inclination, the speed of rotation, the position of any scraper devices, the degree of charging of the like, and also the nature and properties of the coal (particle size range and the like). However, as the classification (the separation into particles of different sizes) is easily recognisable for the technician by its flow lines, he can easily select the spray and feed zones which are specially suited in each case using the abovementioned guidelines, in order to achieve the desired concentration gradients.

Grading effects also occur as a result of flow lines in other pelletising devices, for example drums or cones, from which the technician can establish the spray and feed zones suitable in each case, so that the concentration gradients of the binders required according to the invention can be obtained.

The following example will serve to explain the invention

EXAMPLE 500 of hard coal (particle size 0–3 mm, with 90% less than 1 mm; water content approx. 8% in the crude state; ash content 14% in the anhydrous state) are mixed with 25 g of limestone dust (particle size 80% less than 90 μm, $CaCO_3$ content: 97%) and fed to a usual laboratory pelletising disc (diam. 40 cm, height 10 cm). This mixture was pelletised with the addition of 25 g of normal commercial cane molasses (dry mass approx. 45%) and 33 g of a bitumen emulsion (bitumen B 80, water content 40%) as follows:

At a rotation frequency of the disc of 40 $min^{-1}$ and an angle of 45°, the particles initially fed to the disc were first of all sprayed with molasses, until the first pellet cores had formed. Then emulsion and molasses were sprayed on alternately, the spray time of the emulsion being increased as the size of the pellets grew. For the last spraying operation bitumen emulsion was used. The pellets obtained had sizes in the range from 8 to 15 mm.

The green pellets were heated in a drying cupboard to 110° C. within 5 hours. The water content dropped to less than 3%. Next followed the second stage (hardening) of the two stage thermal post-treatment namely heating at 200° C. for 3 hours. The coal pellets produced in this way had a smooth, closed surface and a crushing strength of 10 to 15 kp (98 to 147N) when stored dry and 9 to 12 kp (88N to 117N) when stored in the damp (3 days at 100% air humidity and 25° C.).

COMPARATIVE EXPERIMENT A

The pelletisation took place as in the Example. Pellets were dried, but not subjected to the second step of the thermal post-treatment. When stored dry they had a crushing strength of 10 to 15 kp (98 to 147N) after being stored damp, the determination of the crushing strength, however, gave figures of less than 1 kp (9.8N).

COMPARATIVE EXPERIMENT B

A sprayable total mixture was produced from cane molasses and a bitumen of the same type and then using the same quantities as used in the Example.

Hard coal and limestone of the same type and in the same quantities as used in the Example were pelletised by spraying with this total sprayable mixture in the apparatus described in the Example. The same overall concentration of cane molasses and bitumen were present in the finished green pellet as in the Example.

The two stage thermal post-treatment (drying and hardening) was carried out as in the Example. The resulting coal pellets had a crushing strength of 10–15 kp (98–147N) when stored dry; when stored in the damp the crushing strength dropped to approximately 1.5 kp (15N).

We claim:

1. A process for the pelletization of finely divided solid carbonaceous material using a first binder which is a water-soluble or swellable thermo-hardening material and a second binder which is an aqueous emulsion of a heavy hydrocarbon and comprising the steps of drying and then thermally hardening the pellets is characterised by the fact that by adding the first and second binder separately during the pelletization process, the concentration of the first binder in the green pellet decreasing from the interior of the exterior and that of the second binder from the exterior to the interior.

2. A process according to claim 1 characterized by the fact that the first binder is added to the finely divided solid carbonaceous material in a quantity of 1 to 5 percent by weight, calculated as dry substance and reckoned on the quantity of carbonaceous material used.

3. Process according to claim 1 characterised by the fact that the second binder is added to the finely divided solid carbonaceous material in a quantity of 1 to 6 percent by weight, calculated as hydrocarbon and weight of finely divided solid carbonaceous material.

4. Process according to claim 1 characterised by the fact that the concentration gradient in the pellets is set by applying the first binder preferentially to the non-agglomerated feed to the pelletizing process or to the smaller agglomerates, and the second binder preferentially to the larger agglomerates.

5. Process according to claim 4 characterised in that the smaller agglomerates initially formed in the pelletising process are preferentially present at a first location and later formed, larger agglomerates are preferentially present at a second location spaced apart from the first location and the concentration gradients are fixed by regulating the amounts of first and second binder applied at the first and second locations.

6. Process according to claim 4 characterised by the fact that in the case of non-continuous production, the concentration gradient in the pellets is produced by alternating spraying with the first and second binders, the spray times for the first binder being set successively shorter and for the second binder successively longer.

7. A process according to claim 1 wherein both first and second binders are fed to the pelletisation step.

8. Process according to claim 1 characterised by the fact that the fact that the green pellets are dried at temperatures of 80° to 180° C. to a water content of 0.5 to 6 percent by weight.

9. Process according to claim 8 characterised by the fact that the dried green pellets are hardened at temperatures of 200° to 300° C.

10. Process according to claim 8 wherein the green pellets are maintained in motion while they are dried.

* * * * *

UNITED STATES PATENT AND TRADEMARK OFFICE

CERTIFICATE OF CORRECTION

PATENT NO. : 4,501,593

DATED : February 26, 1985

INVENTOR(S) : Michael Paersch, Herbert Mrotzek, Helmut Haukelt and Heinz-Wilhelm Schreckenberg It is certified that error appears in the above-identified patent and that said Letters Patent is hereby corrected as shown below:

Column 4, line 3, "it" should read --is--.

Column 4, line 35, delete "a".

Column 5, line 53, after "500" insert --g--.

Claim 1, line 47, delete "of" (first occurrence) and insert --to--.

Signed and Sealed this

*Fifteenth* Day of *October 1985*

[SEAL]

*Attest:*

DONALD J. QUIGG

*Attesting Officer*

*Commissioner of Patents and Trademarks—Designate*